US011408601B1

(12) United States Patent
Lu et al.

(10) Patent No.: US 11,408,601 B1
(45) Date of Patent: Aug. 9, 2022

(54) ILLUMINATION DEVICE WITH COUPLE LAMP TUBES HAVING TEMPERATURE AND POWER ADJUSTMENT FUNCTIONS

(71) Applicant: Xiamen PVTECH Co., Ltd., Fujian (CN)

(72) Inventors: Fuxing Lu, Fujian (CN); Rongtu Liu, Fujian (CN); Honggang Sun, Fujian (CN)

(73) Assignee: Xiamen PVTECH Co., Ltd., Fujian (CN)

( * ) Notice: Subject to any disclaimer, the term of this patent is extended or adjusted under 35 U.S.C. 154(b) by 0 days.

(21) Appl. No.: 17/411,051

(22) Filed: Aug. 24, 2021

(30) Foreign Application Priority Data

May 31, 2021 (CN) ..... 202110597339.4

(51) Int. Cl.

| | |
|---|---|
| ***F21K 9/272*** | (2016.01) |
| ***F21V 23/06*** | (2006.01) |
| ***F21V 23/04*** | (2006.01) |
| *F21Y 115/10* | (2016.01) |
| *F21Y 103/10* | (2016.01) |

(52) U.S. Cl.
CPC ..... *F21V 23/06* (2013.01); *F21V 23/04* (2013.01); *F21Y 2103/10* (2016.08); *F21Y 2115/10* (2016.08)

(58) Field of Classification Search
CPC ..... F21V 23/06; F21V 23/004; F21V 23/005; F21K 9/20; F21K 9/27; F21K 9/272; F21K 9/278
See application file for complete search history.

(56) References Cited

U.S. PATENT DOCUMENTS

| | | | | |
|---|---|---|---|---|
| 7,594,738 | B1 * | 9/2009 | Lin | F21V 23/006 362/225 |
| 8,466,619 | B2 * | 6/2013 | Lee | H05B 45/34 362/249.03 |
| 9,510,400 | B2 * | 11/2016 | Scapa | H05B 45/00 |
| 10,683,969 | B2 * | 6/2020 | Jeswani | F21K 9/278 |
| 10,794,549 | B2 * | 10/2020 | Pritchett | F21L 4/022 |
| 10,893,587 | B2 * | 1/2021 | Halliwell | H05B 47/19 |
| 11,209,150 | B1 * | 12/2021 | Lu | F21K 9/272 |
| 11,248,754 | B2 * | 2/2022 | Li | F21V 23/006 |
| 2013/0122724 | A1 * | 5/2013 | Velazquez | F21V 21/005 439/39 |
| 2018/0209614 | A1 * | 7/2018 | Sperling | F21V 23/04 |
| 2020/0400297 | A1 * | 12/2020 | Hou | F21V 15/012 |
| 2021/0136888 | A1 * | 5/2021 | Vasquez | F21V 23/04 |
| 2021/0404608 | A1 * | 12/2021 | Li | F21V 23/06 |

* cited by examiner

*Primary Examiner* — Ismael Negron
(74) *Attorney, Agent, or Firm* — Winston Hsu

(57) ABSTRACT

A first lamp tube includes a first lamp housing, a plurality of first light-emitting elements disposed within the first lamp housing, a first lamp head connected to the first lamp housing, and a color temperature switch module disposed on the first lamp head. A second lamp tube includes a second lamp housing, a plurality of second light-emitting elements disposed within the second lamp housing, a second lamp head connected to the second lamp housing, and a power adjustment terminal disposed on the second lamp head configured to be connected to an external power adjustment device. A coupling assembly is disposed between the first lamp housing and the second lamp housing to fix the first lamp housing to the second lamp housing, and electrically connect the first lamp tube to the second lamp tube.

10 Claims, 6 Drawing Sheets

ILLUMINATION DEVICE WITH COUPLE LAMP TUBES HAVING TEMPERATURE AND POWER ADJUSTMENT FUNCTIONS

CROSS REFERENCE TO RELATED APPLICATION

This application claims the benefit of priority to China Patent Application No. 202110597339.4, filed May 31, 2021, and included herein by reference in its entirety.

BACKGROUND OF THE INVENTION

1. Field of the Invention

The technical field relates to a lamp tube, in particular to a coupled lamp tube with color temperature and power adjustment functions.

2. Description of the Prior Art

As the development of light-emitting diode (LED) lighting technology greatly advances, LED lamp tubes are gradually applied to people's daily life. Compared with conventional lamp tubes, LED lamp tubes have many advantages which conventional lamp tubes lack, such as small size, energy-saving, environmentally-friendly, high efficiency, long service life, etc.

However, currently available LED lamp tubes still have many shortcomings which need to be improved. For instance, the color temperature and the power of most LED lamp tubes cannot be adjusted, which is very inconvenient in use. Besides, the inventory pressures of product providers also increase accordingly.

Further, some places need long lamp tubes, but the transportation and the storage of long lamp tubes are very inconvenient, which increases the transportation and storage costs.

SUMMARY OF THE INVENTION

An embodiment of the present invention relates to a coupled lamp tube with color temperature and power adjustment functions, which includes a first lamp tube, a second lamp tube and a coupling assembly. The first lamp tube includes a first lamp head, a color temperature switch module and a first lamp housing. The color temperature switch module is disposed on the first lamp head. The first lamp head is connected to the first lamp housing. The second lamp tube includes a second lamp head, a power adjustment terminal and a second lamp housing. The power adjustment terminal is disposed on the second lamp head. The second lamp head is connected to the second lamp housing. The coupling assembly is disposed between the first lamp housing and the second lamp housing so as to make the first lamp housing be fixed to the second lamp housing, such that the first lamp tube is electrically connected to the second lamp tube.

In one embodiment of the present invention, the power adjustment terminal is connected to an external power adjustment device.

In one embodiment of the present invention, the first lamp housing includes a first circuit board and a plurality of first light-emitting elements. The first light-emitting elements are disposed on the first circuit board and one end of the first circuit board is connected to the color temperature switch module.

In one embodiment of the present invention, the second lamp housing includes a second circuit board and a plurality of second light-emitting elements. The second light-emitting elements are disposed on the second circuit board and one end of the second circuit board is connected to the power adjustment terminal.

In one embodiment of the present invention, the second lamp tube further includes a power source module and one end of the second circuit board is connected to the power adjustment terminal via the power source module.

In one embodiment of the present invention, the coupling assembly includes a first connection element and a plurality of metal connection sleeves. One end of the first connection element is sleeved on and connected to the first lamp housing and the metal connection elements are disposed on the first lamp housing.

In one embodiment of the present invention, the coupling assembly further includes a second connection element and a plurality of metal connection pins. One end of the second connection element is sleeved on and connected to the second lamp housing and the other end of the second connection element is sleeved on and connected to the other end of the first connection element. The metal connection pins are inserted into the metal connection sleeves.

In one embodiment of the present invention, the color temperature switch module is a toggle switch, a rotary switch, a push-button switch or other similar components.

In one embodiment of the present invention, the first lamp head further includes a plurality of first metal pins and the first metal pins are disposed at one end of the first lamp head.

In one embodiment of the present invention, the second lamp head further includes a plurality of second metal pins and the second metal pins are disposed at one end of the second lamp head.

As set forth above, the coupled lamp tube with color temperature and power adjustment functions in accordance with the embodiments of the present invention may have the following advantages:

(1) In one embodiment of the present invention, the coupled lamp tube can make the first lamp housing and the second lamp housing be stably fixed with each other via the coupling assembly, such that the first lamp tube can be electrically connected to the second lamp tube. Thus, the first lamp tube and the second lamp tube can be effectively spliced together to form a complete lamp tube, which can make the transportation and the storage of the coupled lamp tube more convenient in order to dramatically reduce the transportation and storage costs thereof.

(2) In one embodiment of the present invention, the coupling assembly of the coupled lamp tube includes a first connection element and a second connection element. One end of the second connection element is sleeved on and connected to the first connection element. The other end of the second connection element is sleeved on and connected to the other end of the first connection element. This mechanism can more stably make the first lamp tube and the second lamp tube be fixed with each other, so the structure of the coupled lamp tube can be stabler.

(3) In one embodiment of the present invention, the first lamp tube and the second lamp tube of the coupled lamp tube are provided with a color temperature switch module and a power adjustment terminal respectively, such that the coupled lamp tube can simultaneously provide the color temperature adjustment function and the power adjustment function. Therefore, the user can adjust the color temperature and/or the power of the coupled lamp tube according to actual requirements, so the application of the coupled lamp tube can be more comprehensive.

(4) In one embodiment of the present invention, the design of the coupled lamp tube is simple, so can achieve the desired technical effects without significantly increasing the cost. Thus, the coupled lamp tube can have high commercial value.

Further scope of applicability of the present application will become more apparent from the detailed description given hereinafter. However, it should be understood that the detailed description and specific examples, while indicating exemplary embodiments of the present invention, are given by way of illustration only, since various changes and modifications within the spirit and scope of the present invention will become apparent to those skilled in the art from this These and other objectives of the present invention will no doubt become obvious to those of ordinary skill in the art after reading the following detailed description of the preferred embodiment that is illustrated in the various figures and drawings.

BRIEF DESCRIPTION OF THE DRAWINGS

The present invention will become more fully understood from the detailed description given herein below and the accompanying drawings which are given by way of illustration only, and thus are not imitative of the present invention and wherein.

DETAILED DESCRIPTION

Figure 1:
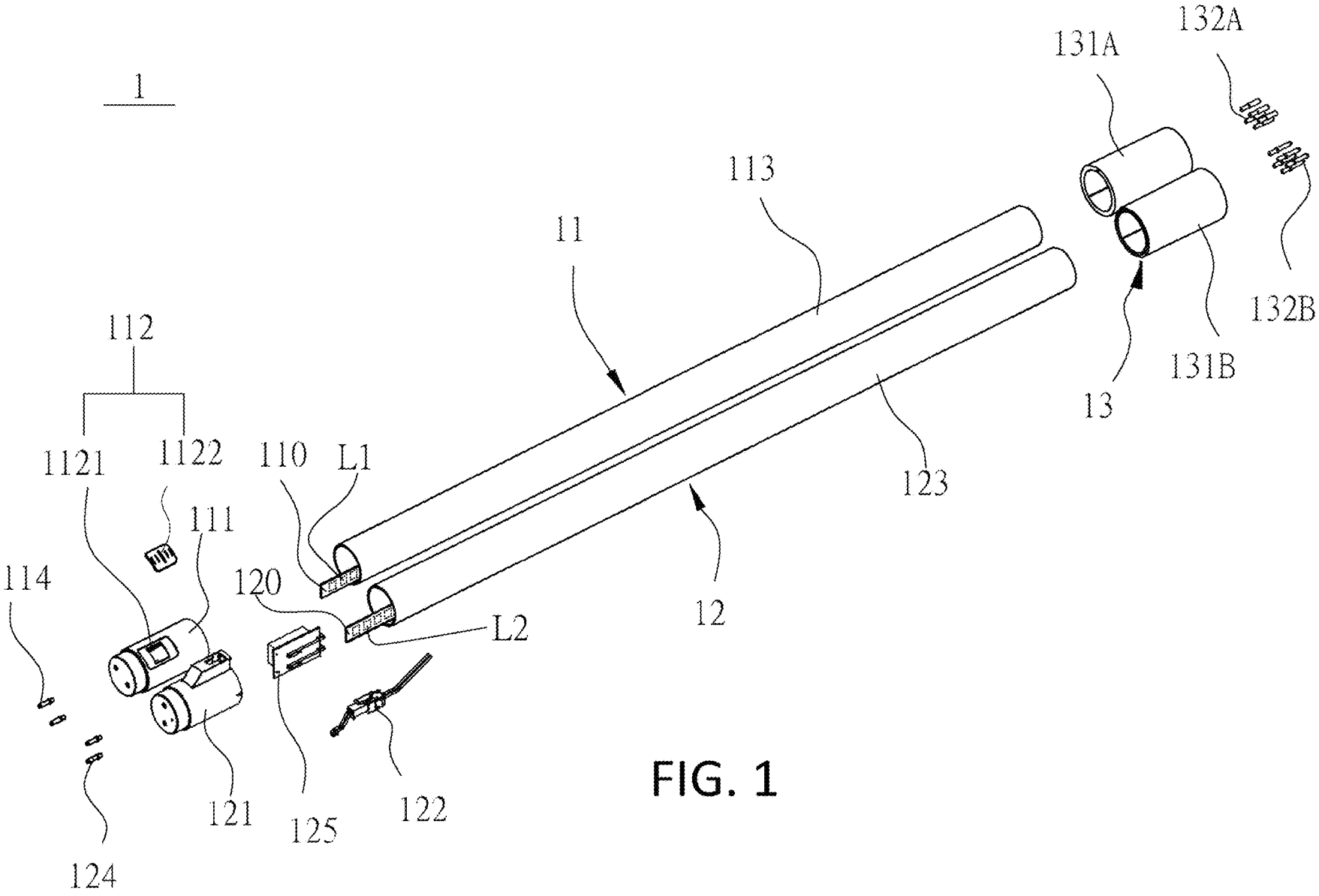
FIG. 1 is an exploded view of a coupled lamp tube with color temperature and power adjustment functions in accordance with one embodiment of the present invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Figure 2A:
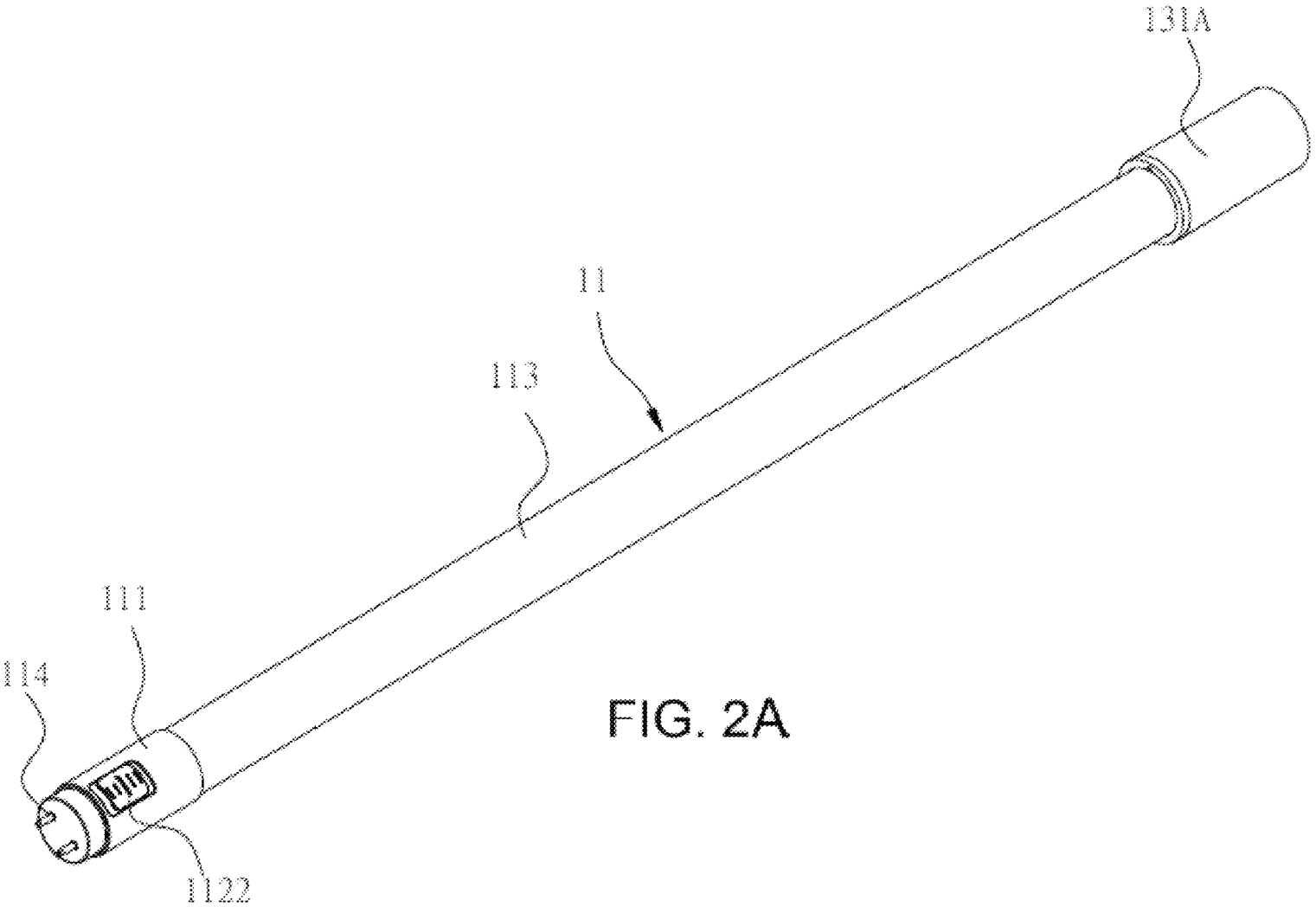
FIG. 2A and FIG. 2B are an assembly view of a first lamp tube and an assembly view of a second lamp tube of the coupled lamp tube with color temperature and power adjustment functions in accordance with one embodiment of the present invention.
Figure 2B:
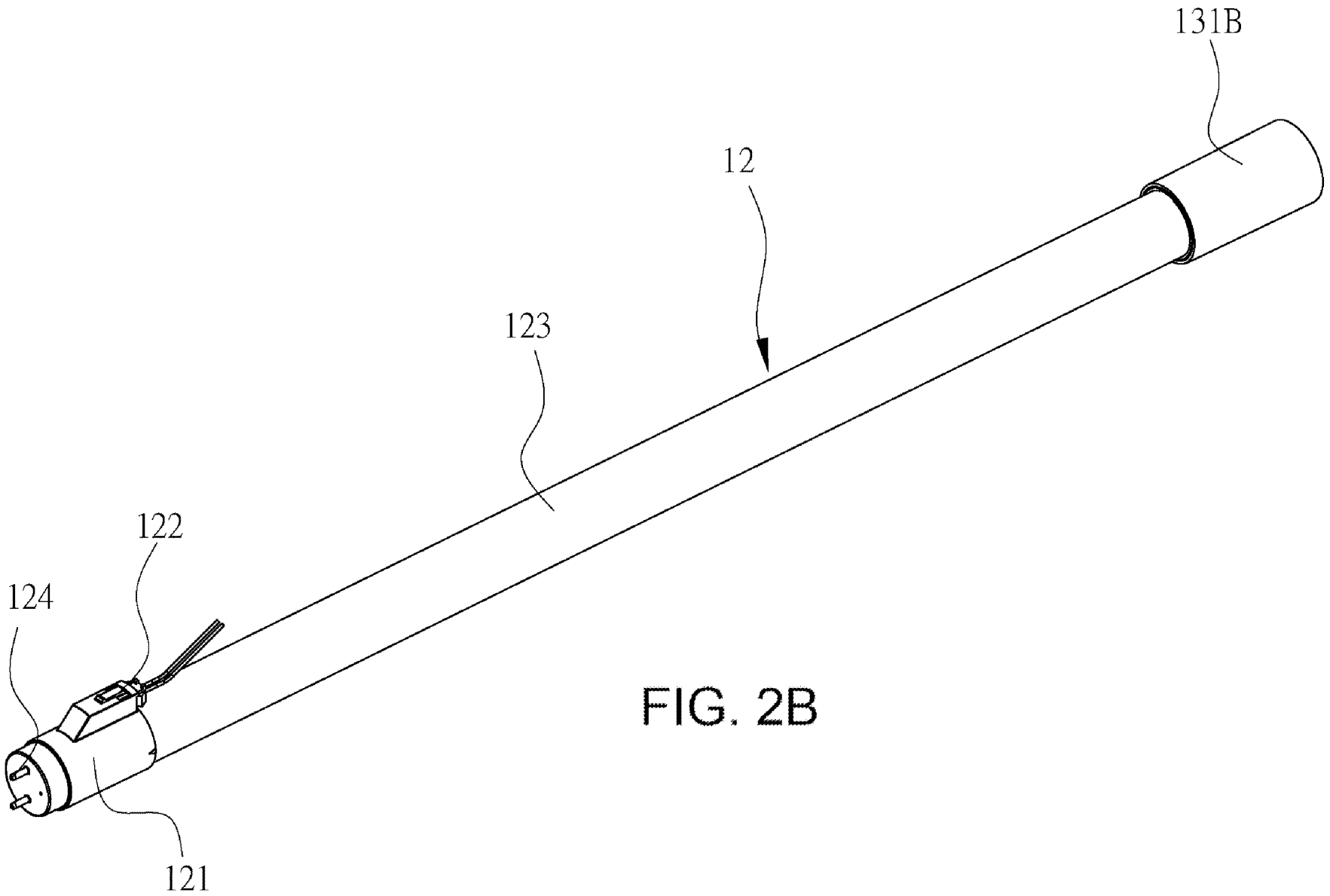

Please refer to FIG. 1, FIG. 2A and FIG. 2B. FIG. 1 is an exploded view of a coupled lamp tube with color temperature and power adjustment functions in accordance with one embodiment of the present invention. FIG. 2A and FIG.2B are an assembly view of a first lamp tube and an assembly view of a second lamp tube of the coupled lamp tube with color temperature and power adjustment functions in accordance with one embodiment of the present invention. As shown in FIG. 1, FIG. 2A and FIG. 2B, the coupled lamp tube 1 with color temperature and power adjustment functions includes a first lamp tube 11, a second lamp tube 12 and a coupling assembly 13.

The first lamp tube 11 includes a first lamp head 111, a color temperature switch module 112, a first lamp housing 113 and a plurality of first metal pins 114. The color temperature switch module 112 is disposed on the first lamp head 111 and the first lamp head 111 is connected to the first lamp housing 113. In this embodiment, the color temperature switch module 112 may be, but not limited to, a toggle switch, which includes a main switch body 1121 and a toggle button 1122. In another embodiment, the color temperature switch module 112 may also be rotary switch, push-button switch or other similar components. In addition, the first lamp housing 113 further includes a first circuit board 110 and a plurality of first light-emitting elements L1. These light-emitting elements L1 are disposed on the first circuit board 110 and one end of the first circuit board 110 is connected to the color temperature switch module 112. The first metal pins 114 are disposed at one end of the first lamp head 111. In this way, the components of the first lamp tube 11 can be electrically connected to each other.

The second lamp tube 12 includes a second lamp head 121, a power adjustment terminal 122, a second lamp housing 123, a plurality of second metal pins 124 and a power source module 125. The power adjustment terminal 122 is disposed on the second lamp head 121 and the second lamp head 121 is connected to the second lamp housing 123. The power adjustment terminal 122 is connected to an external power adjustment device, such that the user can adjust the power of the coupled lamp tube 1. Similarly, the second lamp housing 123 further includes a second circuit board 120 and a plurality of second light-emitting elements L2. These second light-emitting elements L2 are disposed on the second circuit board 120 and one end of the second circuit board 120 is connected to the power adjustment terminal 122 via the power source module 125. These second metal pins 124 are disposed at one end of the second lamp head 121. In this way, the components of the second lamp tube 12 can be electrically connected to each other. In this embodiment, the first light-emitting elements L1 and the second light-emitting elements L2 may be, but not limited to, light-emitting diodes (LED). In another embodiment, the first light-emitting elements L1 and the second light-emitting elements L2 may also be any one of other currently available light-emitting components.

The coupling assembly 13 includes a first connection element 131A, a second connection element 131B, a plurality of metal connection sleeves 132A and a plurality of metal connection pins 132B. One end of the first connection element 131A is sleeved on and connected to the first lamp housing 113 and the metal connection sleeves 132A are disposed on the first lamp housing 113. One end of the second connection element 131B is sleeved on and connected to the second lamp housing 123 and the metal connection pins 132B are disposed on the second lamp housing 123.

Figure 3:
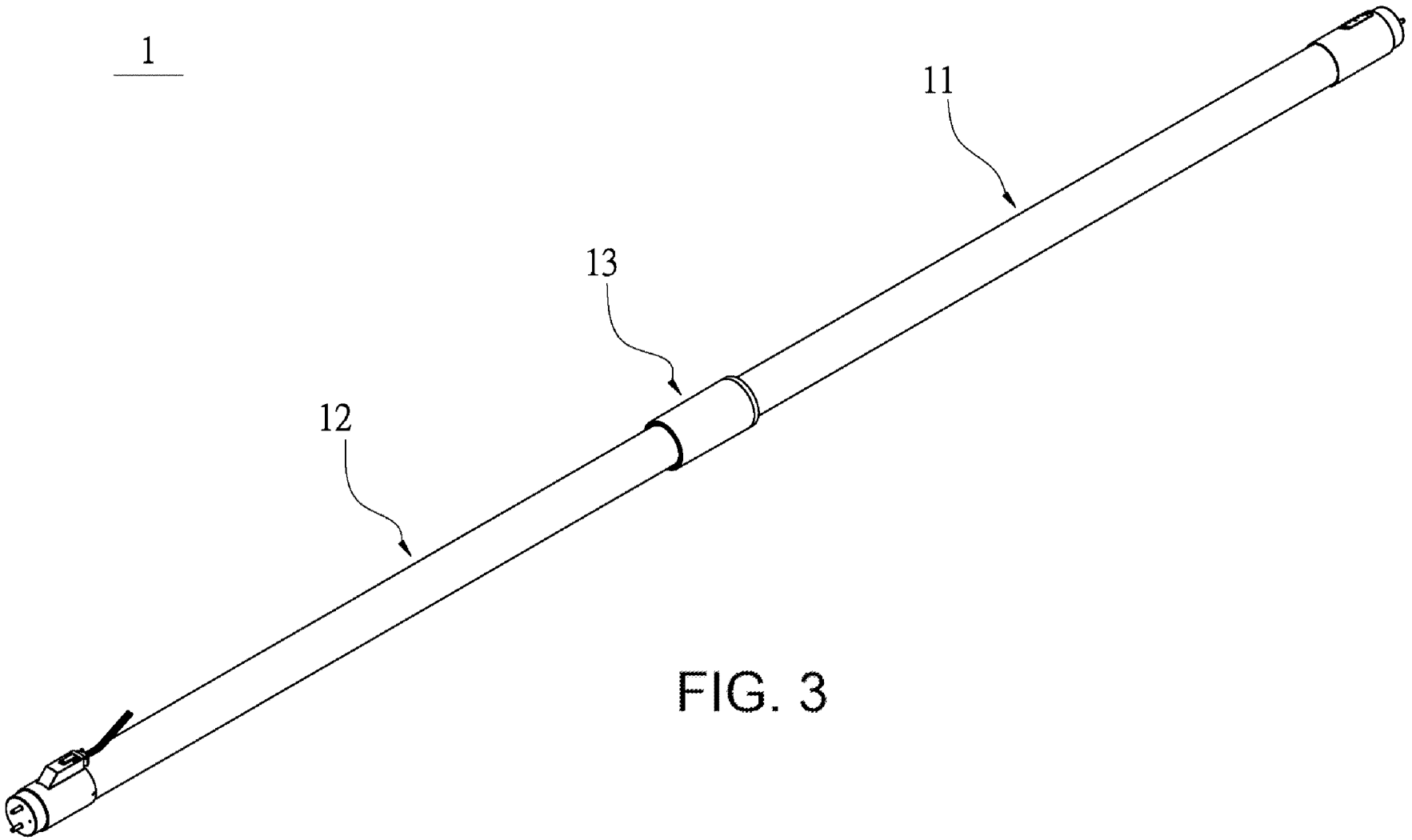
FIG. 3 is an assembly view of a second lamp tube of the coupled lamp tube with color temperature and power adjustment functions in accordance with one embodiment of the present invention.

Please refer to FIG. 3, which is an assembly view of a second lamp tube of the coupled lamp tube with color temperature and power adjustment functions in accordance with one embodiment of the present invention. As shown in FIG. 3, the other end of the second connection element 131B is sleeved on and connected to the other end of the first connection element 131A, such that the metal connection pins 132B can be inserted into the metal connection sleeves 132A. Therefore, the coupling assembly 13 disposed between the first lamp housing 113 and the second lamp housing 123 can fix the first lamp housing 113 and the second lamp housing 123. Thus, the first lamp tube 11 can be electrically connected to the second lamp tube 12.

As described above, the coupled lamp tube 1 with color temperature and power adjustment functions can fix the first lamp housing 113 and the second lamp housing 123 via the coupling assembly 13. As a result, the first lamp tube 11 and the second lamp tube 12 can be electrically connected to each other, so the first lamp tube 11 and the second lamp tube 12 can be effectively spliced together to form a completely lamp tube. For the reason, the transportation and the storage of the coupled lamp tube 1 can be more convenient, which can significantly reduce the transportation and storage costs thereof. Moreover, the length of the coupled lamp tube 1 can be up to or greater than 2.4 m, which can satisfy the requirements in various applications.

The embodiment just exemplifies the present invention and is not intended to limit the scope of the present invention. Any equivalent modification and variation according to the spirit of the present invention is to be also included within the scope of the following claims and their equivalents.

Figure 4:
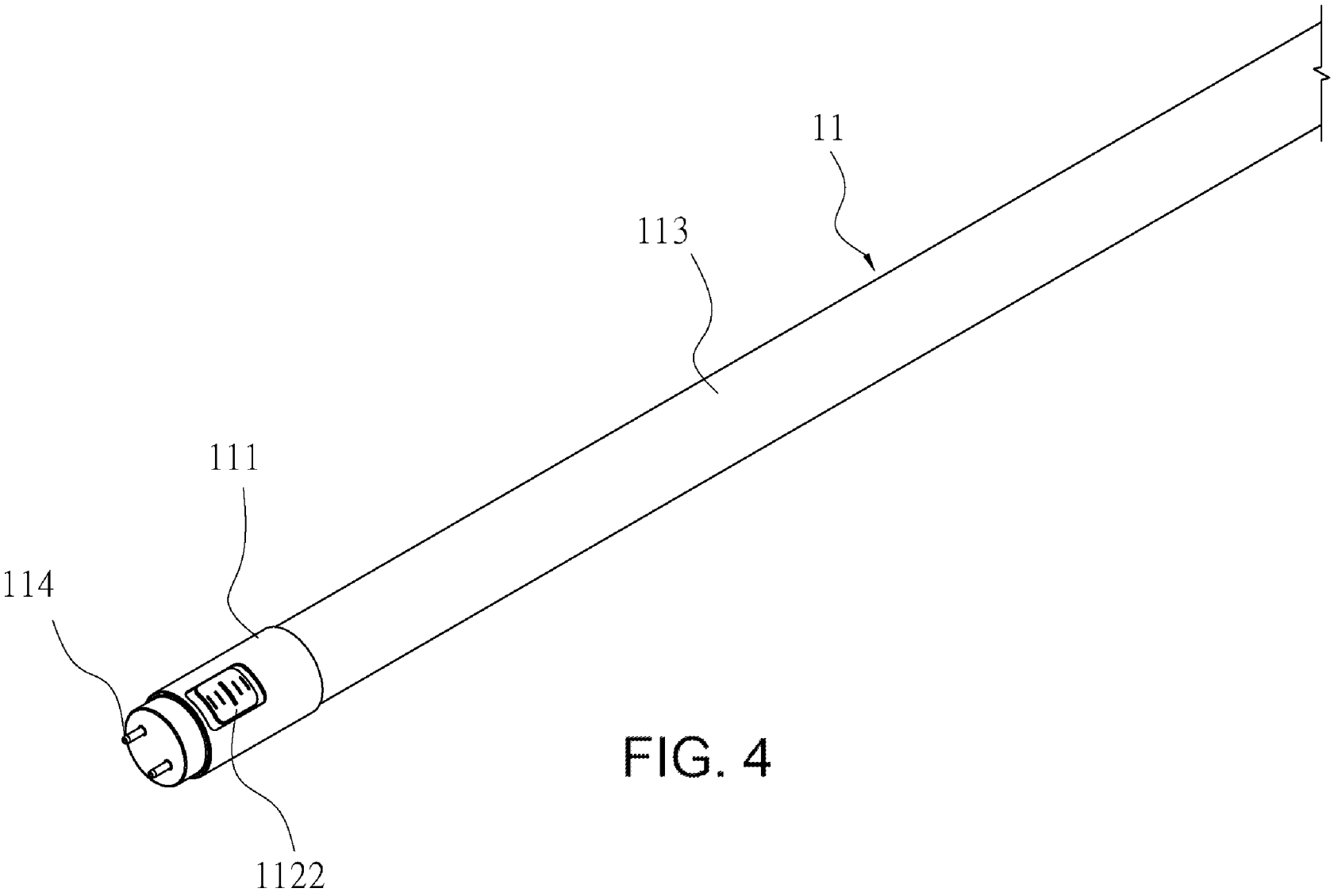
FIG. 4 is a first partial enlargement view of the coupled lamp tube with color temperature and power adjustment functions in accordance with one embodiment of the present invention.

Please refer to FIG. 4, which is a first partial enlargement view of the coupled lamp tube with color temperature and power adjustment functions in accordance with one embodiment of the present invention. As shown in FIG. 4, the first lamp head 111 of the first lamp tube 11 is provided with the color temperature switch module 112. Thus, the user can switch the toggle button 1122 of the color temperature switch module 112 to adjust the color temperature of the light-emitting elements between several color temperature levels.

The embodiment just exemplifies the present invention and is not intended to limit the scope of the present invention. Any equivalent modification and variation according to the spirit of the present invention is to be also included within the scope of the following claims and their equivalents.

Figure 5:
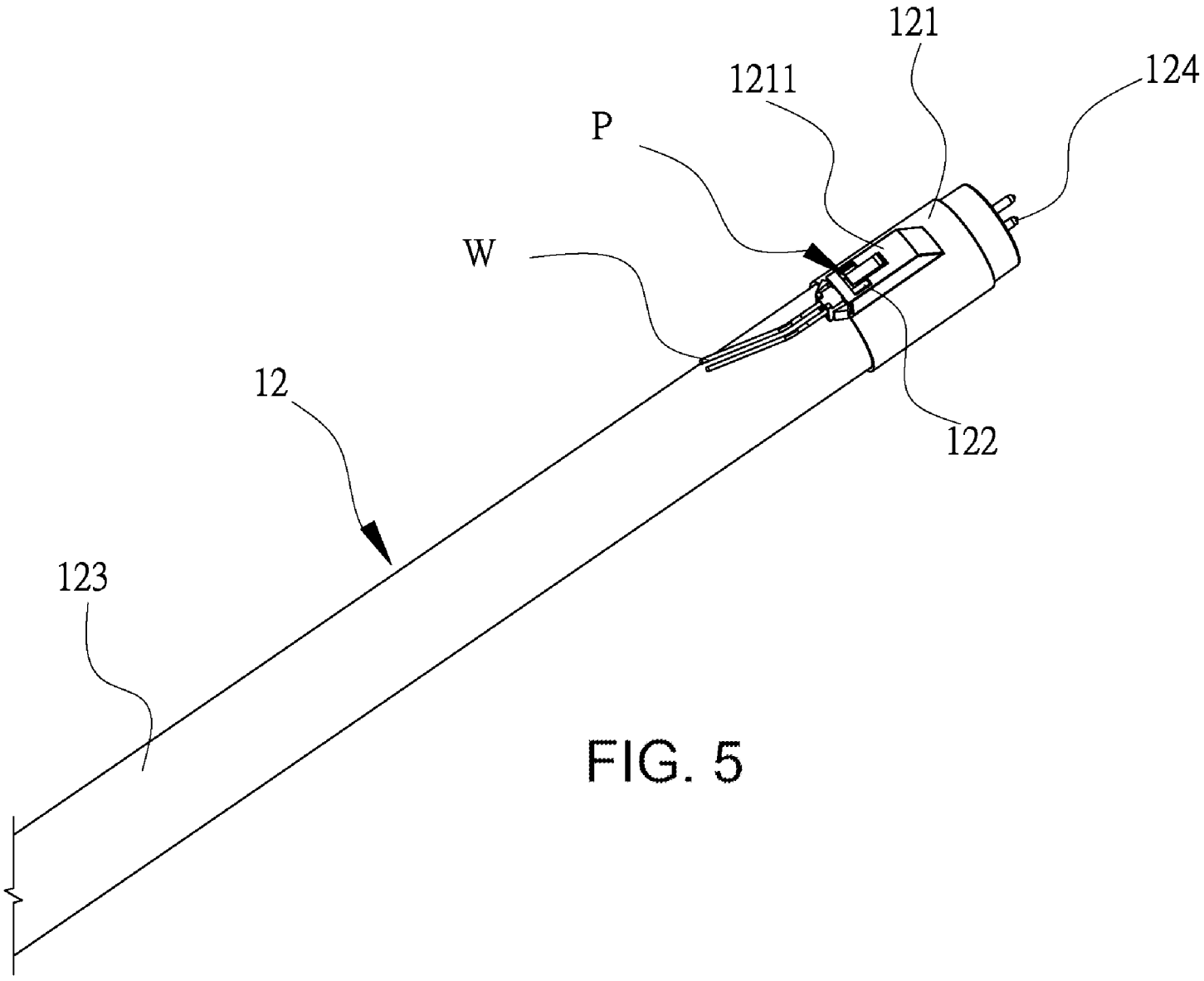
FIG. 5 is a second partial enlargement view of the coupled lamp tube with color temperature and power adjustment functions in accordance with one embodiment of the present invention.

Please refer to FIG. 5, which is a second partial enlargement view of the coupled lamp tube with color temperature and power adjustment functions in accordance with one embodiment of the present invention. As shown in FIG. 5, the second lamp head 121 is provided with a terminal base 1211 and the power adjustment terminal 122 is disposed in the terminal base 1211. In addition, the terminal base 1211 has an opening P. In this embodiment, the opening P may be, but not limited to, T-shaped. A portion of the power adjustment terminal 122 protrudes from the opening P. The power adjustment terminal 122 can be detachably disposed in the terminal base 1211 via the corresponding structures at the two sides thereof. One end of the power adjustment terminal 122 is connected to the power source module 125 and the other end of the power adjustment terminal 122 is connected to an external power adjustment device via a wire W. Via the above design, the user can adjust the power of the light-emitting elements.

The embodiment just exemplifies the present invention and is not intended to limit the scope of the present invention. Any equivalent modification and variation according to the spirit of the present invention is to be also included within the scope of the following claims and their equivalents.

To sum up, according to one embodiment of the present invention, the coupled lamp tube can make the first lamp housing and the second lamp housing be stably fixed with each other via the coupling assembly, such that the first lamp tube can be electrically connected to the second lamp tube. Thus, the first lamp tube and the second lamp tube can be effectively spliced together to form a complete lamp tube, which can make the transportation and the storage of the coupled lamp tube more convenient in order to dramatically reduce the transportation and storage costs thereof.

Besides, according to one embodiment of the present invention, the coupling assembly of the coupled lamp tube includes a first connection element and a second connection element. One end of the second connection element is sleeved on and connected to the first connection element. The other end of the second connection element is sleeved on and connected to the other end of the first connection element. This mechanism can more stably fix the first lamp tube and the second lamp tube-, so the structure of the coupled lamp tube can be stable.

Further, according to one embodiment of the present invention, the first lamp tube and the second lamp tube of the coupled lamp tube are provided with a color temperature switch module and a power adjustment terminal respectively, such that the coupled lamp tube can simultaneously provide the color temperature adjustment function and the power adjustment function. Therefore, the user can adjust the color temperature and/or the power of the coupled lamp tube according to actual requirements, so the application of the coupled lamp tube can be more comprehensive.

Moreover, according to one embodiment of the present invention, the design of the coupled lamp tube is simple, so can achieve the desired technical effects without significantly increasing the cost. Thus, the coupled lamp tube can have high commercial value.

It will be apparent to those skilled in the art that various modifications and variations can be made to the disclosed embodiments. It is intended that the specification and examples be considered as exemplary only, with a true scope of the present invention being indicated by the following claims and their equivalents.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An illumination device comprising:

a first lamp tube, comprising a first lamp housing, a first lamp head connected to the first lamp housing, and a color temperature switch module disposed on the first lamp head;

a second lamp tube, comprising a second lamp housing, a second lamp head connected to the second lamp housing, and a power adjustment terminal disposed on the second lamp head; and a coupling assembly, disposed between the first lamp housing and the second lamp housing to fix the first lamp housing and the second lamp housing, and electrically connecting the first lamp tube to the second lamp tube.

2. The illumination device of claim 1, wherein the power adjustment terminal is configured to be connected to an external power adjustment device.

3. The illumination device of claim 1, the color temperature switch module is a toggle switch, a rotary switch or a push-button switch.

4. The illumination device of claim 1, the first lamp head further comprises a plurality of first metal pins and the first metal pins are disposed at one end of the first lamp head.

5. The illumination device of claim 1, the second lamp head further comprises a plurality of second metal pins disposed at one end of the second lamp head.

6. The illumination device of claim 1, the coupling assembly comprises a first connection element having a first end [[is ]] sleeved on and connected to the first lamp housing, and a plurality of metal connection sleeves disposed on the first lamp housing.

7. The illumination device of claim 6, the coupling assembly further comprises a second connection element having a third end sleeved on and connected to the second lamp housing, and fourth end sleeved on and connected to a second end of the first connection element; and a plurality of metal connection pins inserted into the metal connection sleeves.

8. The illumination device of claim 1, wherein the first lamp housing comprises a first circuit board having one end connected to the color temperature switch module, and a plurality of first light-emitting elements disposed on the first circuit board.

9. The illumination device of claim 8, wherein the second lamp housing comprises a second circuit board having one end connected to the power adjustment module, and a plurality of second light-emitting elements disposed on the second circuit board.

10. The illumination device of claim 9, wherein the second lamp tube further comprises a power source module, and one end of the second circuit board is connected to the power adjustment terminal via the power source module.

* * * * *